US005922128A

United States Patent [19]

Kustermann et al.

[11] Patent Number: 5,922,128

[45] Date of Patent: Jul. 13, 1999

[54] APPLICATOR DEVICE FOR COATING RUNNING WEBS

[75] Inventors: Martin Kustermann; Hans-Peter Sollinger, both of Heidenheim, Germany

[73] Assignee: J.M. Voith GmbH, Heidenheim, Germany

[21] Appl. No.: 08/247,672

[22] Filed: May 23, 1994

Related U.S. Application Data

[60] Division of application No. 07/631,375, Dec. 20, 1990, Pat. No. 5,340,611, which is a continuation-in-part of application No. 07/385,212, Jul. 25, 1989, Pat. No. 4,980,207.

[30] Foreign Application Priority Data

Jan. 26, 1990 [DE] Germany ..... 40 02 256

[51] Int. Cl.[6] ..... B05C 1/08; B05C 11/02

[52] U.S. Cl. ..... 118/110; 118/119; 118/206; 118/249; 118/255; 118/262; 118/412

[58] Field of Search ..... 118/110, 118, 118/119, 126, 206, 249, 255, 262, 264, 414, 407, 412, 419

[56] References Cited

U.S. PATENT DOCUMENTS

| | | | |
|---|---|---|---|
| 2,061,526 | 11/1936 | Storck | 118/249 |
| 2,293,690 | 8/1942 | Harrigan | 118/249 |
| 2,513,394 | 7/1950 | Barrett et al. | 118/249 |
| 2,545,905 | 3/1951 | Thomas | 118/249 |
| 2,560,572 | 7/1951 | Haywood et al. | 118/262 |
| 2,729,192 | 1/1956 | Warner | 118/262 |
| 2,937,955 | 5/1960 | Loomer | 118/255 |
| 2,970,564 | 2/1961 | Warner | 118/262 |
| 3,084,663 | 4/1963 | Warner | 118/119 |
| 3,088,842 | 5/1963 | Kuhnel | 118/262 |
| 3,179,536 | 4/1965 | Martinek | 118/407 |
| 3,202,536 | 8/1965 | Brezinski | 118/206 |
| 3,312,191 | 4/1967 | Lowe | 118/119 |
| 3,817,208 | 6/1974 | Barnscheidt et al. | 118/119 |
| 4,357,370 | 11/1982 | Alheid | 118/206 |
| 4,367,691 | 1/1983 | Bergs | 118/119 |
| 4,848,268 | 7/1989 | Sollinger et al. | 118/206 |
| 5,031,569 | 7/1991 | Eriksson | 118/407 |

*Primary Examiner*—Steven P. Griffin
*Attorney, Agent, or Firm*—Baker & Daniels

[57] ABSTRACT

In a device for the coating of a running web of paper or cardboard, provisions are that in a press gap formed between two rolls a coating substance applied in a very small quantity on the surface of the one roll is first pressed on the web leaving a very thin coat on the web which, however, covers all spots including the "mounds" of microroughness. Next, the second coat can be applied and dosed on the still moist first coat with the usual means. In the process, the first coat is preferably dosed on the shell of the first roll, by means of the peripheral grooves of a rotary doctor. The same may be performed also as regards the second coating on the web.

3 Claims, 2 Drawing Sheets

APPLICATOR DEVICE FOR COATING RUNNING WEBS

This is a division of application Ser. No. 07/631,375, filed Dec. 20, 1990, now U.S. Pat. No. 5,340,611, which is a continuation-in-part of application Ser. No. 07/385,212 filed Jul. 25, 1989, now U.S. Pat. No. 4,980,207.

BACKGROUND OF THE INVENTION

The invention concerns a process for coating running webs of paper or cardboard where two coats are applied in direct succession, one upon the other, while the first coat is still moist. For both the first and second coatings there is at least one rotatable roll provided for support of the web, and at least the second coat is applied and dosed directly on the web.

A process for coating running webs with two successive coating operations, where the first coat is still moist as the second is applied, is known from the U.S. Pat. No. 3,202,536. The two coating stations are both arranged on a single roll guiding the web and on two successive rolls. A so-called airbrush is used as a final smoothing element. An applicator device of appropriate kind with a roll supporting the web on a coating device is known also from the Canadian Patent Document 882,640. In this case, the coat is applied by means of an applicator roll and scraped off by a doctor blade. A mixture for the coating substance is used that consists of a kaolin substance as well as starch, protein or thermoplastic synthetic resin. U.S. Pat. No. 3,202,536, provides that the first application coat has a relatively high consistency, i.e., with a solid substance content of more than 55%, while the second coat has a considerably lower consistency with a lower solid substance content of maximally 45%, where the major share is always kaolin.

Due to the high speeds in coating, using an airbrush is very problematic today; the airbrush can practically be used only up to speeds of 500 m/min. Considering the competitive pressures existing today, this can be a grave disadvantage, although the airbrush has the great advantage that with it a flawless coating can be achieved despite a relatively sparing application.

The problem underlying the invention is to propose a device and a process with which a flawless coating of a web can be achieved. This is true especially for use with cardboard, where the surface roughness of the base cardboard is relatively great, and where other coating processes, for instance such using a blade as equalizing element, may ensue bare spots at the protruding "mounds".

SUMMARY OF THE INVENTION

According to the present invention, the coating substance is practically in the first coating application pressed on the web from the surface of the first web support roll, by means of the pressure prevailing in the press gap formed between the two interacting rolls, which certainly involves a brief deformation of the paper web. The applied or transferred amount is relatively low, and at that, in such a way that a remaining behind of solid substance particles of the coating substance is assured also on the "mounds" of microroughness. The contact pressure and the hydraulic pressure in the press gap causes a certain dewatering of the coating substance of the first coat, but the moisture content of the coating substance is retained. The "pre-dewatering" in the press gap ensures the adherence of the coating substance everywhere on the web, also on the "mounds". A certain intermediate drying before the application of the second coat is possible.

For the coating of cardboard it has been demonstrated to be favorable to only dose the second application coat by means of the grooves of a rotary doctor provided with peripheral grooving, without acting on the coat with another smoothing element. With proper adjustment of the consistency of the coating substance, a sufficient spreading is accomplished, making an additional smoothing unnecessary, which might be associated with scrape-off disadvantages.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figures 1, 2, 3, 4:
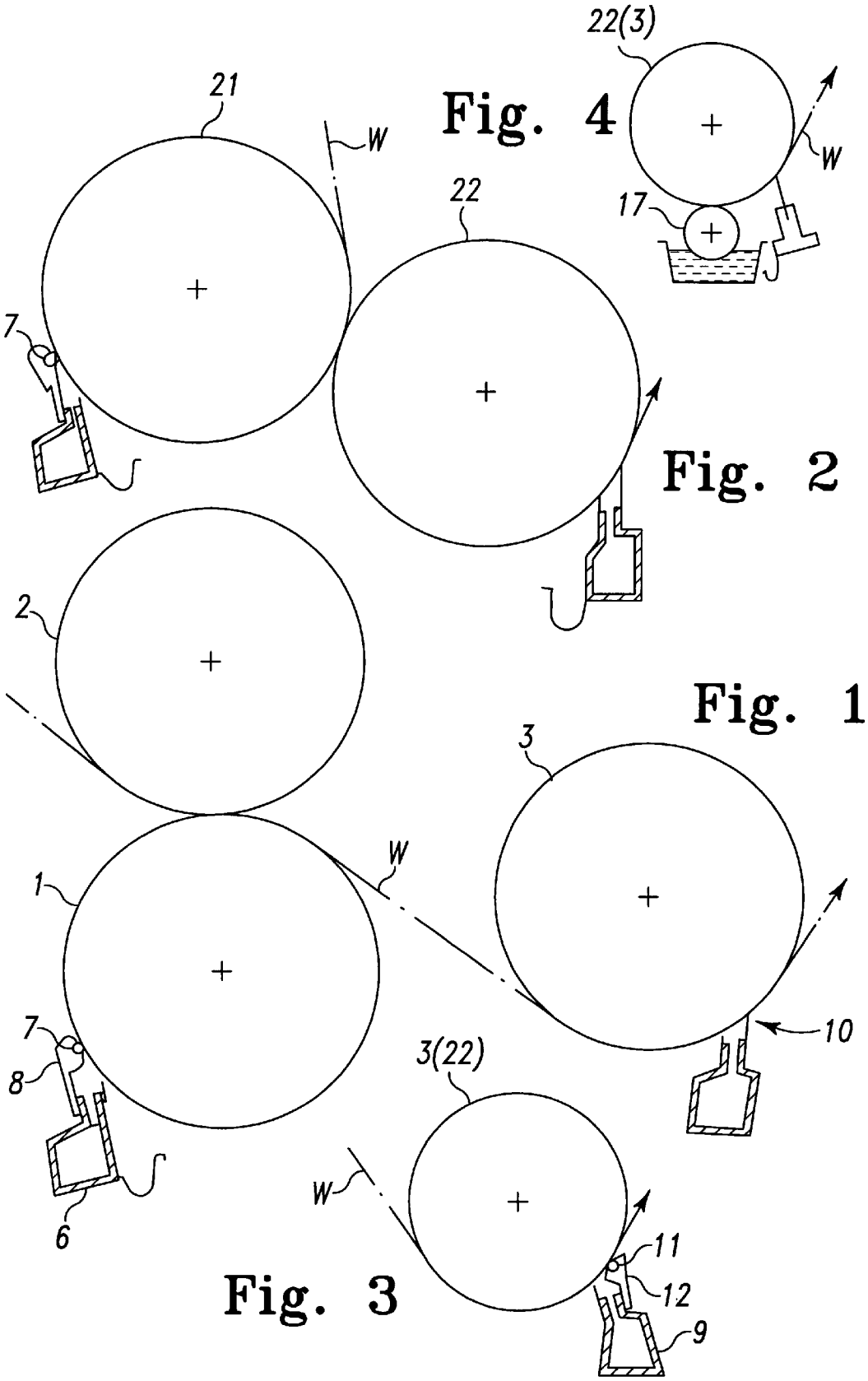
FIG. 1 is an apparatus for coating a running web of paper or cardboard in accordance with the present invention.
FIG. 2 is an alternate embodiment of the coating apparatus of the present invention wherein only two rolls are utilized.
FIG. 3 is another embodiment of tie coating apparatus of the present invention wherein a rotary doctor provided with peripheral grooving is provided as a dosing element for the final dosing.
FIG. 4 is a further embodiment of the present invention wherein a transfer roll is utilized to apply the coating substance.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

According to FIG. 1, the web W runs through a press gap formed between two rolls 1 and 2. Coordinated with roll 1, which is provided with a rubberized surface, is an applicator mechanism that features a nozzle chamber 6 and, on its discharge end, a rotary doctor 7 provided with peripheral or helical grooving and a holder 8 for the latter. The hardness of the rubber coating of roll 1 may range between 0 and 200, preferably 10 and 70 Pucey and Jones (PuJ). A small dosed quantity of coating substance applied in the first coating layer in the case of cardboard is dimensioned to be 6 to 40 $ml/m^2$, preferably 12 to 22 $ml/m^2$. The second coat may be applied using a comparable arrangement with rotary doctor 11 and its holder 12, along with a nozzle chamber 9, but where the equalizing element may also be a blade or a smooth rotary doctor at the point 10. As the web passes through the press gap, the small dosed quantity of coating substance applied to roll 1 is pressed on the web so that at least a thin layer of first coating substance covers the web.

The applicable consistencies, i.e., solid or pigment substance contents, range for the first coat between 50 and 70% maximum, and for the second coat between 60 and 70% maximum. It has been found to be favorable to provide for the applicator mechanism a nozzle chamber 6, 9 on the discharge end of which, near the surface to be coated, a rotary doctor 7, 11 with its holder 8, 12 is arranged. Thus, the advantage here is, over the airbrush method, that the process may be performed with a relatively high consistency overall, but especially for the second coat. The line pressures in the press gap between the two first rolls 1 and 2 range between 5 and 60 kNmm, preferably 20 to 40 kNTm.

The setup according to FIG. 2 has totally only two web support rolls 21 and 22, with an applicator device of the described type coordinated with each. This arrangement is possible in the case of cardboard because it stretches less than paper due to the moistening in the coater. In other words, the second applicator device serving the application of the second coat is provided on the second web support roll 22, which is coordinated with first web support roll 21.

A favorable option in the case of cardboard is providing on the leaving end of the nozzle chamber 9 as dosing element for the second coat (final dosing) a rotary doctor 11 provided with peripheral grooving and a holder 12, and to omit a further smoothing element thereafter. This is illustrated in FIG. 3. With this setup, a very good coating can be obtained at relatively sparing use of coating substance.

Illustrated additionally, in FIG. 4, for the second coating device is a transfer roll 17 for the coating substance that may be used as well. A scraping by means of one of the known dosing elements is to be provided thereafter.

In a specific application area, in the case of sizing application for paper, it is possible to dose the first coat also with a blade or a suitable lath, instead of a rotary doctor provided with grooves, but the action of the blade needs to be very closely monitored here.

Figure 5:
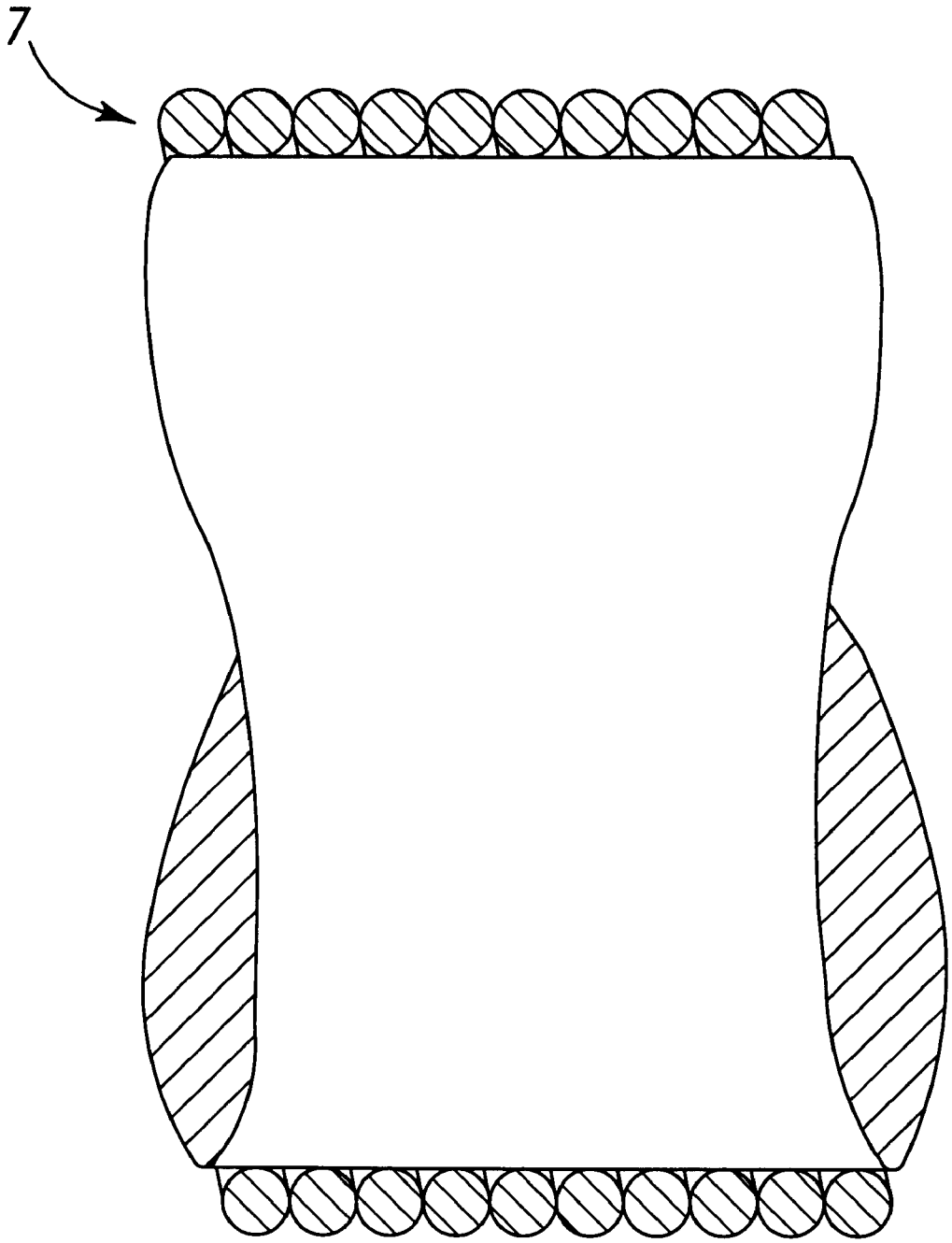
FIG. 5 is a partial sectional view of a rotary doctor according to the present invention showing the closely adjacent fine peripheral or helical grooves.

FIG. 5 shows a rotary doctor according to an embodiment of the present invention, wherein the rotary doctor is provided with closely adjacent fine peripheral or helical grooving.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for coating a running web, comprising:

a rotatable roll having a rubberized surface for the support of the web during a first coating process;

first applicator means for applying to the surface of the rotatable roll during the first coating process a small dosed quantity of a first coating substance, said first applicator means including a nozzle chamber having a discharge end near the rotatable roll surface through which said first coating substance is passed, said first applicator means further including at said discharge end a rotary doctor and a holder for said rotary doctor, said rotary doctor having closely adjacent fine peripheral grooves or helical grooves, said first coating substance having a solid or pigment substance content between 50% and 70%;

a backing roll, said backing roll configured and juxtaposed with respect to said rotatable roll such that a press gap for pressing at least a thin layer of said dosed quantity of said first coating substance on the web is formed between the backing roll and the rotatable roll said backing roll providing support for the web during a second coating process; and second applicator means for applying a layer of a second coating substance directly on said web during said second coating process, said layer of second coating substance being applied in direct succession to the layer of first coating substance one upon the other while the layer of first coating substance is still moist, said second applicator means including a nozzle chamber having a discharge end near the web to be coated through which the second coating substance is passed, said second applicator means further including a rotary doctor and a holder for said rotary doctor of said second applicator means, said rotary doctor and holder arranged at said second applicator means discharge end.

2. The device of claim 1, wherein the rubberized surface has a hardness between 0 and 200 P u.J.

3. The device of claim 2, wherein said rubberized surface has a hardness between 10 and 70 P u.J.

* * * * *